US007845116B2

(12) United States Patent
Masuda

(10) Patent No.: US 7,845,116 B2
(45) Date of Patent: Dec. 7, 2010

(54) GUIDE APPARATUS FOR SLIDING DOOR

(75) Inventor: Hiroyuki Masuda, Chiba (JP)

(73) Assignee: Sugatsune Kogyo Co., Ltd., Tokyo (JP)

( * ) Notice: Subject to any disclaimer, the term of this patent is extended or adjusted under 35 U.S.C. 154(b) by 525 days.

(21) Appl. No.: 11/909,565

(22) PCT Filed: Mar. 8, 2006

(86) PCT No.: PCT/JP2006/304451

§ 371 (c)(1),
(2), (4) Date: Sep. 24, 2007

(87) PCT Pub. No.: WO2006/100910

PCT Pub. Date: Sep. 28, 2006

(65) Prior Publication Data

US 2009/0049752 A1 Feb. 26, 2009

(30) Foreign Application Priority Data

Mar. 23, 2005 (JP) ..... 2005-083286

(51) Int. Cl.
*E05D 15/10* (2006.01)

(52) U.S. Cl. ..... 49/223; 49/221; 49/218; 49/216; 49/125; 49/127; 49/128

(58) Field of Classification Search ..... 49/208, 49/209, 212, 216, 217, 218, 221, 223, 260, 49/404, 425, 125, 127, 128, 129, 130
See application file for complete search history.

(56) References Cited

U.S. PATENT DOCUMENTS 3,906,668 A * 9/1975 Simmons ..... 49/212

(Continued)

FOREIGN PATENT DOCUMENTS

CN 2276515 Y 3/1998

(Continued)

OTHER PUBLICATIONS

Patent Abstracts of Japan, Publication No. 2003-097138, dated Apr. 3, 2003, 1 page.

(Continued)

*Primary Examiner*—Katherine W Mitchell
*Assistant Examiner*—Catherine A Kelly
(74) *Attorney, Agent, or Firm*—Osha Liang LLP

(57) ABSTRACT

When a sliding door (3) as a plate-like object is moved in a front and rear direction from a closed position to an opening preparation position, a rotatable rail (20) rotates from a horizontal lying position to a vertical standing position about a rotation axis (L1). When the sliding door is in the opening preparation position, a roller (40) of the sliding door (3) rides on a running track (25*b*) of the rotatable rail (20). When the sliding door (3) is further moved from the opening preparation position to an open position, the roller (40) transfers from the running track (25*b*) to an auxiliary track (26) of an adjacent rotatable rail (20). The rotatable rail (20) is biased toward the standing position by an elastic force of a torsion spring (18) and maintained in the standing position by an arm (13). This allows the sliding door (3) to be returned to the opening preparation position.

7 Claims, 13 Drawing Sheets

U.S. PATENT DOCUMENTS

| | | | | | |
|---|---|---|---|---|---|
| 4,462,185 | A | * | 7/1984 | Shibuki et al. | 49/218 |
| 4,551,945 | A | * | 11/1985 | von Resch | 49/221 |
| 4,644,690 | A | * | 2/1987 | Caimi | 49/130 |
| 5,483,769 | A | * | 1/1996 | Zweili | 49/118 |
| 5,735,080 | A | * | 4/1998 | Pratolongo | 49/209 |
| 5,896,704 | A | * | 4/1999 | Neag et al. | 49/209 |
| 5,921,613 | A | * | 7/1999 | Breunig et al. | 296/155 |
| 6,385,910 | B1 | * | 5/2002 | Smink et al. | 49/218 |
| 6,792,717 | B2 | * | 9/2004 | Carlsson et al. | 49/218 |
| 6,926,342 | B2 | * | 8/2005 | Pommeret et al. | 296/155 |
| 7,426,803 | B2 | * | 9/2008 | Fronz et al. | 49/209 |
| 2007/0033878 | A1 | | 2/2007 | Oshima et al. | |

FOREIGN PATENT DOCUMENTS

| | | | |
|---|---|---|---|
| JP | 62-69571 | | 5/1987 |
| JP | 62-228583 | | 10/1987 |
| JP | 1-151681 | * | 6/1989 |
| JP | 4-101491 | | 9/1992 |
| JP | 2003-97138 | | 4/2003 |
| JP | 2004/006143 | * | 11/2004 |
| JP | 2004-332352 | | 11/2004 |
| WO | 2004-099540 | | 11/2004 |

OTHER PUBLICATIONS

Patent Abstracts of Japan, Publication No. 2004-332352, dated Nov. 25, 2004, 1 page.

International Search Report issued in PCT/JP2006/304451, mailed on May 2, 2006, with translation (4 pages).

Chinese First Office Action in connection with related Chinese patent application No. 200680009247.3, issued on Jun. 7, 2010, and English translation thereof, 14 pages.

English abstract from espacenet for patent application with Publication No. CN2276515, Publication Date : Mar. 18, 1998, 1 page.

* cited by examiner

GUIDE APPARATUS FOR SLIDING DOOR

TECHNICAL FIELD

This invention relates to a guide apparatus for guiding one or a plurality of plate-like objects in a left and right direction.

BACKGROUND ART

Patent Document 1 discloses a guide apparatus for a plurality of sliding doors (plate-like objects) opening and closing an opening of a main body such as a window or furniture. The plurality of sliding doors are flush with each other when all of them are in a closed position (set position). The guide apparatus guides the sliding doors from the closed position to an opening preparation position (preparation position) in front of or behind the closed position, and from the opening preparation position to an open position (non-set position) located to the left or right of the opening preparation position.

The guide apparatus of the Patent Document 1, as shown in FIGS. 21 through 30 of the Patent Document 1, comprises, as a primary guide mechanism, a plurality of rotatable rails supported in a lower edge portion of the opening of the main body and a roller (runner) supported in a lower edge portion of each of the sliding doors.

The plurality of rotatable rails are formed in a horizontally elongated shape extending in a right and left direction. The rotatable rails are arranged in the right and left direction to form a straight line and rotatably supported about a first rotation axis, extending in the right and left direction, between a horizontal lying position (first rotation position) and a vertical standing position (second rotation position).

Each of the rotatable rails includes a receiving groove extending in a longitudinal direction of the rotatable rail. A one side portion (a side portion nearer to the rotation axis) of the receiving groove serves as a running track. The rotatable rail further includes an auxiliary track spaced from the running track by 90 degrees about the first rotation axis.

The roller is swingably supported about a second rotation axis that is parallel to the first rotation axis.

When the sliding door is in the closed position, the corresponding rotatable rail is in the horizontal lying position and the roller is received in the receiving groove of the rotatable rail.

When the sliding door is in the opening preparation position, the corresponding rotatable rail is in the vertical standing position and the roller, received in the receiving groove of the rotatable rail, rides on the running track.

When the sliding door is moved from the opening preparation position to the open position, the roller transfers from the running track of the corresponding rotatable rail onto the auxiliary track of another rotatable rail adjacent to the corresponding rotatable rail.

To allow the sliding door to return to the opening preparation position from the open position, the corresponding rotatable rail must be maintained in the vertical standing position. To meet this requirement, the guide apparatus of the Patent Document 1 includes a structure for maintaining the rotatable rail in the vertical standing position. As shown in FIG. 24 of the Patent Document 1, the rail-holding structure includes a ball received in a receiving hole of the rotatable rail and a compression coil spring urging the ball in a protruding direction. The ball is engaged in a recess of a rail support part of the main body side, thereby maintaining the rotatable rail in the standing position.

Patent Document 1: International Publication No. WO2004/099540

DISCLOSURE OF THE INVENTION

Problem to be Solved by the Invention

However, in the rail-holding structure of the Patent Document 1, once the ball is disengaged from the recess of the rail support part by an external force, the rotatable rail cannot return to the standing position. This is a problem since it prohibits the sliding door from returning to the opening preparation position.

Means for Solving the Problem

The present invention has been accomplished to solve the above-mentioned problem. According to the present invention, there is provided a guide apparatus for guiding a movement of a plate-like object (3) with respect to a main body (1) between a set position and a preparation position in front of or behind the set position, and between the preparation position and a non-set position to the left or right of the preparation position, comprising: a rotatable rail (20) formed in an elongated shape horizontally extending in a right and left direction and supported by the main body such that said rotatable rail can rotate about a first rotation axis (L1) extending in the right and left direction between a first rotation position and a second rotation position, the rotatable rail including a receiving groove (25) extending in a longitudinal direction of the rotatable rail, a one side portion of the receiving groove being provided as a running track (25*b*); a runner (40) supported by the plate-like object such that the runner can swing about a second rotation axis (L2) parallel to the first rotation axis (L1); and an adjacent rotatable rail (20) disposed adjacent to the rotatable rail and having an auxiliary track (26), the auxiliary track extending in the right and left direction, the auxiliary track becoming continuous with the running track of the rotatable rail when the rotatable rail is in the second rotation position. When the plate-like object (3) is in the set position, the rotatable rail (20) is in the first rotation position and the runner (40) is received in the receiving groove (25) of the rotatable rail. When the plate-like object is in the preparation position, the rotatable rail is in the second rotation position and the runner is received in the receiving groove of the rotatable rail and rides on the running track (25*b*). When the plate-like object is moved from the preparation position to the non-set position, the runner transfers from the running track onto the auxiliary track (26). The guide apparatus further comprises: a biasing member (18) biasing the rotatable rail (20) toward the second rotation position; and a stop member (13) for maintaining the rotatable rail (20) at the second rotation position against the biasing member.

According to another aspect of the present invention, there is provided a guide apparatus for guiding a movement of each of a plurality of plate-like objects (3) with respect to a main body (1) between a set position and a preparation position in front of or behind the set position, and between the preparation position and a non-set position to the left or right of the preparation position, the plurality of plate-like objects being flush with each other when all of the plurality of plate-like objects are in the set positions and arranged in a right and left direction, the guide apparatus comprising: a plurality of rotatable rails (20) formed in an elongated shape horizontally extending in a right and left direction, arranged in a right and left direction to form a straight line and supported by the main body such that each of the rotatable rails can rotate about a first rotation axis (L1) extending in the right and left direction between a first rotation position and a second rotation position; and a runner (40) supported by each of the plurality of plate-like objects such that the runner can swing about a second rotation axis (L2) parallel to the first rotation axis (L1). Each of the rotatable rails includes: a receiving groove (25) extending in a longitudinal direction of the rotatable rail, a one side portion of the receiving groove being provided as a running track (25*b*). Each of the rotatable rails further includes an auxiliary track (26) spaced from the running track by the same angle as the angle between the first rotation position and the second rotation position about the first rotation axis. When each of the plate-like objects (3) is in the set position, corresponding one of the rotatable rails (20) is in the first rotation position and the runner (40) is received in the receiving groove (25) of the corresponding rotatable rail. When each of the plate-like objects is in the preparation position, corresponding one of the rotatable rails is in the second rotation position and the runner is received in the receiving groove and rides on the running track (25*b*) of the corresponding rotatable rail When each of the plate-like objects is moved from the preparation position to the non-set position, the runner transfers from the running track of the corresponding rotatable rail onto the auxiliary track (26) of another of the rotatable rails adjacent to the corresponding rotatable rail. The guide apparatus further comprises a biasing member (18) biasing the rotatable rail (20) toward the second rotation position; and a stop member (13) for maintaining the rotatble rail at the second rotation position against the biasing member.

In the two aspects of the present invention mentioned above, when the plate-like object is in the non-set position, even if the rotatable rail is rotated from the second rotation position toward the first rotation position by an external force, the rotatable rail can be immediately returned to the second rotation position by the biasing member. Therefore, the plate-like object can be returned from the non-set position to the set position.

Preferably, the rotatable rail (20) includes a receiving hole (21) opening at left and right ends of the rotatable rail. A pair of rail support parts (11) are mounted on the main body (1) in such a manner as to sandwich the rotatable rail (20) and rotatably support the rotatable rail (20), each of the rail support parts including a bearing portion (12*b*) fitted into the receiving hole of the rotatable rail. The biasing member (18) is received in the receiving hole at a location deeper than the bearing portion.

In this arrangement, the biasing member is received in the receiving hole, and therefore, can be prevented from deterioration.

Preferably, the biasing member comprises a torsion spring (18), one end of the torsion spring being caught in an end surface of the bearing portion (12*b*), the other end of the torsion spring being caught in an inner periphery of the receiving hole (21).

In this arrangement, the biasing member can be of a simple structure and, a structure to catch the biasing member can be simple, too.

Preferably, a support pin (19) having a flange (19*a*) at a distal end thereof is secured to the rail support part (11), the support pin projecting from an end surface of the bearing portion (12*b*) along the first rotation axis (L1), the support pin passing through the torsion spring (18) inside the receiving hole (21) of the rotatable rail (20), the torsion spring being arranged between the bearing portion and the flange of the support pin. A catch groove (22) extending in a longitudinal direction of the rotatable rail (20) is formed in the inner periphery of the receiving hole (21) of the rotatable rail (20), the other end of the torsion spring (18) being inserted in the catch groove.

This arrangement allows the torsion spring to be assembled into the rotatable rail easily and securely.

Preferably, the guide apparatus further comprises an elongated damper (90) received in the receiving hole (21) of the rotatable rail (20), the damper including a shaft (91), a tubular member (92) placed over an outer periphery of the shaft and viscous resistance material filling a gap between the outer periphery of the shaft and an inner periphery of the tubular member. The shaft (91) is fixed to the rail support part (11) and projects from the end face of the bearing portion 12*b* along the first rotation axis (L1), the shaft (91) passing through the torsion spring (18). The tubular member (92) is prevented from rotating with respect to the inner periphery of the receiving hole of the rotatable rail.

In this arrangement, when the plate-like object is moved between the set position and the preparation position, impact due to a weight of the plate-like object can be absorbed by the damper.

Preferably, when the rotatable rail (20) is in the second rotation position, the running track (25*b*) is located generally immediately above the first rotation axis (L1). In this arrangement, when the plate-like object is in the preparation position, the rotatable rail in the second rotation position is not affected by the moment of the weight of the plate-like object, and can be securely maintained in the second rotation position by the biasing member.

Preferably, the rotatable rail has a flat cross-sectional configuration and lies down horizontally when in the first rotation position and stands up vertically when in the second rotation position. Preferably, the runner has a flat configuration and lies down horizontally when the rotatable rail is in the first rotation position and stands up vertically when the rotatable rail is in the second rotation position.

Preferably, an opening section (2*x*) corresponding to the plate-like object (3) is formed in the main body (1), the plate-like object closing the opening section when in the set position, the plate-like object opening the opening section when in the non-set position.

More preferably, a primary guide mechanism (5) is disposed in one of upper and lower edge portions of the opening section (2*x*) and a secondary guide mechanism (6) is disposed in the other of the upper and lower edge portions of the opening section. The primary guide mechanism includes the rotatable rail (20) disposed in the one of the upper and lower edge portions of the opening section and the runner (40) disposed in one of upper and lower edge portions of the plate-like object (3). The secondary guide mechanism includes a first guide channel (65) disposed in the other of the upper and lower edge portions of the opening section, the first guide channel extending in a front and rear direction, a second guide channel (61*g*) extending in a right and left direction intersecting the first guide channel and a slider (70) disposed in the other of the upper and lower edge portions of the plate-like object (3). The slider is guided by the first guide channel to make a movement in a front and rear direction with a vertical displacement when the plate-like object is moved between the set position and the preparation position, and the slider is guided by the second guide channel to move in a right and left direction when the plate-like object is moved between the preparation position and the non-set position.

This arrangement allows the plate-like object to be guided securely.

EFFECT OF THE INVENTION

According to this invention, the rotatable rail can be securely maintained in the second rotation position, which allows the plate-like object in the non-set position to be surely returned to the preparation position.

BRIEF DESCRIPTION OF THE DRAWINGS

FIG. 14(A) is a cross-sectional view of a first rail; FIG. 14(B) is a side view of a joint metal disposed at opposite ends of the first rail; FIG. 14(C) is a side view of a joint metal disposed in an intermediate portion of the first rail; and FIG. 14(D) is a cross-sectional view of a second rail.

DESCRIPTION OF THE REFERENCE NUMERALS

Figure 1:
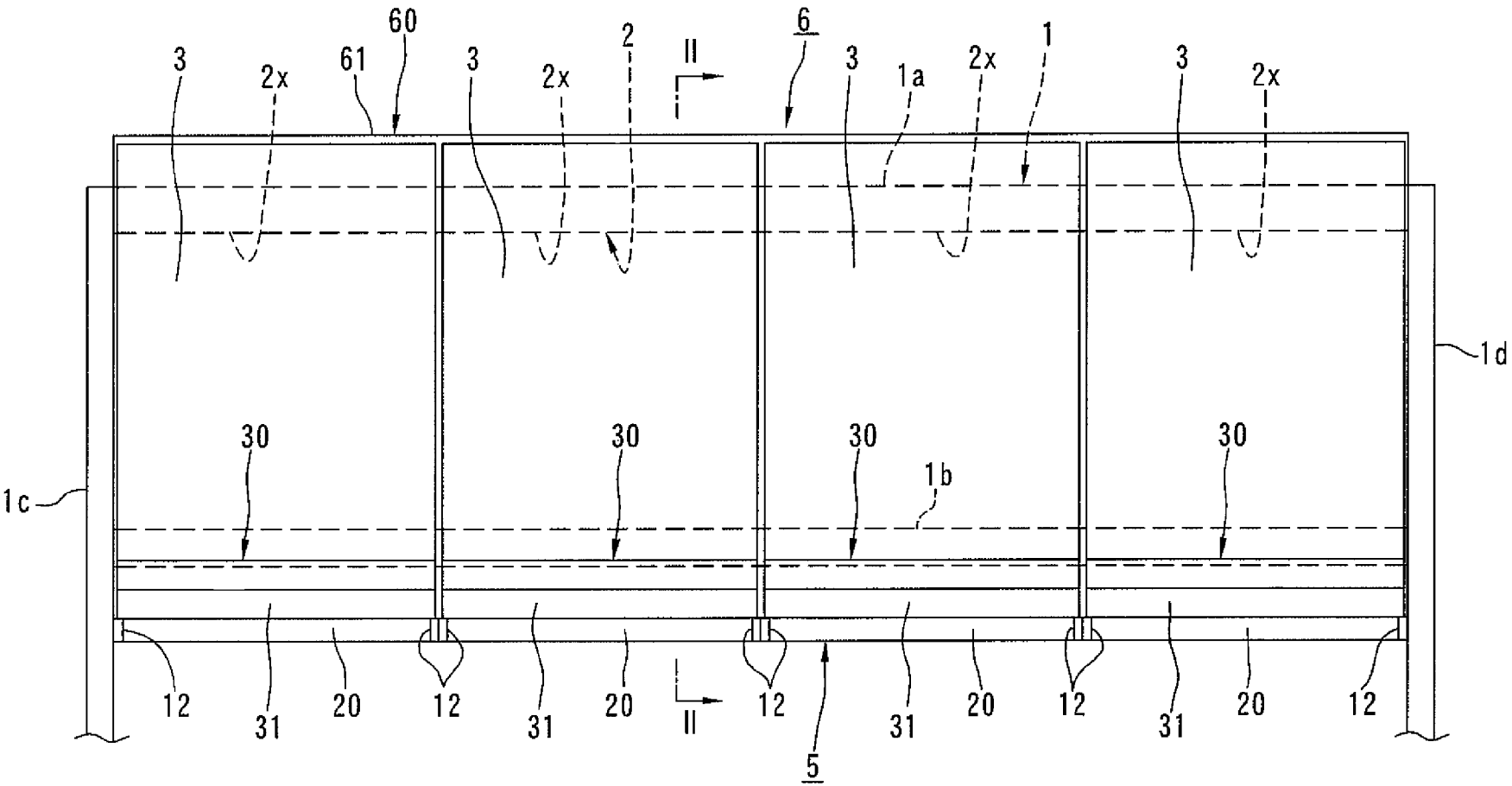
FIG. 1 is a front view of a partition provided with a guide apparatus according to one embodiment of the present invention.

1 frame
2*x* opening section
3 sliding door (plate-like object)
11 support bracket (rail support part)
12*b* bearing portion
18 torsion spring (biasing member)
19 support pin
19*a* flange
20 rotatable rail
21 receiving hole
22 catch groove
25 receiving groove
25*b* running track
26 auxiliary track
40 roller (runner)
60 rail assembly
65 gap (first guide channel)
61*g* guide groove (second guide channel)
70 slider
90 damper
91 shaft
92 tubular member
L1 first rotation axis
L2 second rotation axis

BEST MODE FOR CARRYING OUT THE INVENTION

One embodiment of the present invention will now be described with reference to the drawings. A partition shown in FIG. 1 is used for dividing space such as in a room. The partition includes a horizontally long rectangular frame 1 (main body). The frame 1 is composed of an upper frame portion 1*a* and a lower frame portion 1*b*, both extending horizontally, and left and right frame portions 1*c*, 1*d* extending vertically. The left and right frame portions 1*c*, 1*d* extend downward to serve as support columns, with lower ends of the frame portions fixed on bases (not shown) placed on a floor.

A horizontally long opening 2 defined by the frame 1 is closed by a plurality of, for example, four, sliding doors 3 (plate-like objects) arranged in a right and left direction. The sliding doors 3 are made of vertically long rectangular plates of the same dimensions. An area of the opening 2 corresponding to each of the sliding doors 3 is referred to as an opening section 2*x*. Four opening sections 2*x* are continuous. In this embodiment, the sliding doors 3 can move from a left end to a right end of the frame 1.

When all of the sliding doors 3 are in closed positions, they are arranged on the same vertical surface, flush with each other. The sliding doors 3 are guided to be opened and closed by a sliding door guide apparatus.

A lower structure 5 (primary guide mechanism) of the sliding door guide apparatus will be described first. The lower structure 5 comprises a rotatable rail 20 disposed on a lower edge portion of each of the opening sections 2*x*, i.e. the lower frame portion 1*b*, and a pair of right and left rollers 40 (runners) disposed on a lower edge portion of each of the sliding doors 3.

Figure 2:
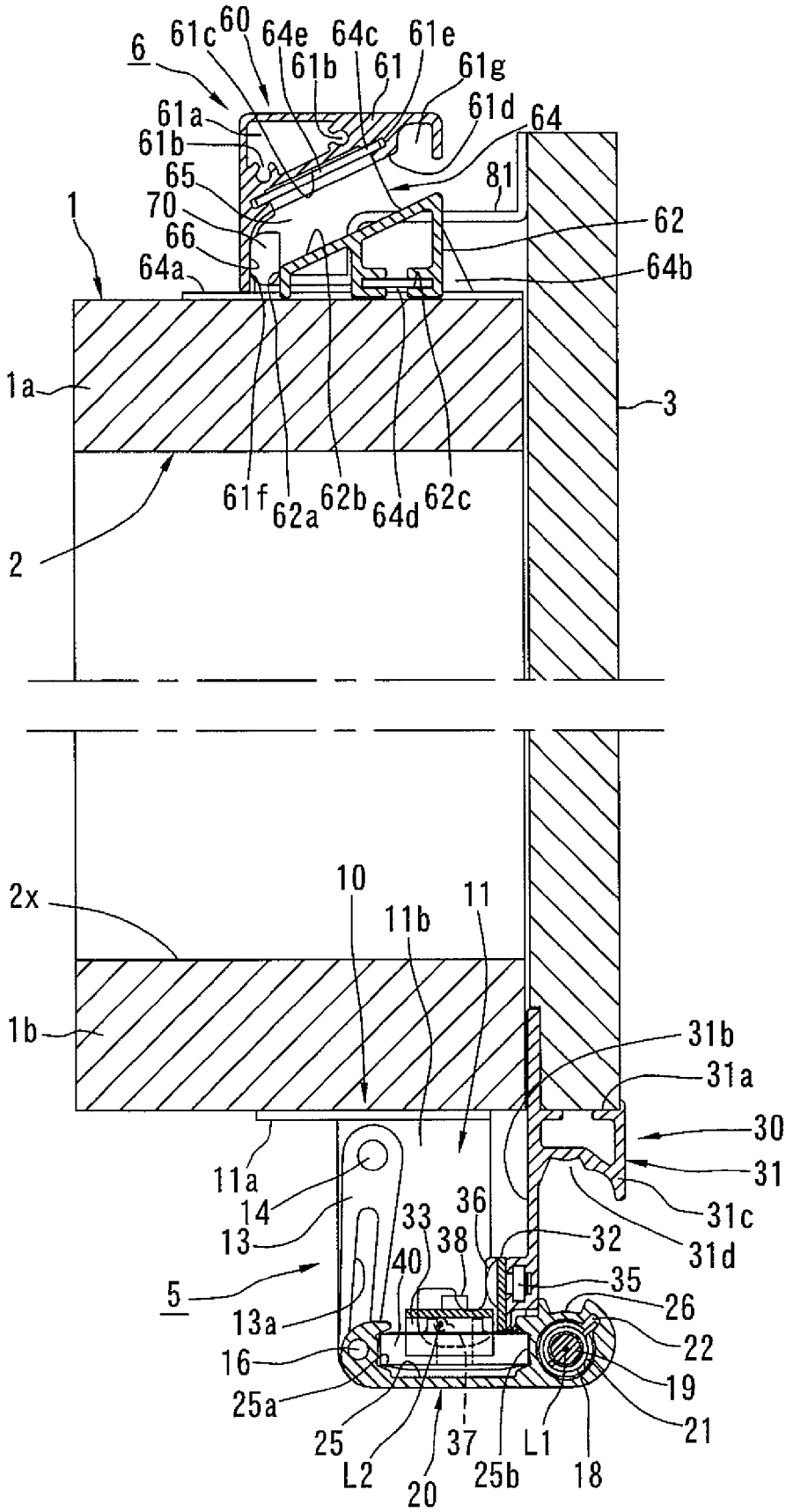
FIG. 2 is an enlarged vertical sectional view of the guide apparatus of FIG. 1 taken along line II-II, showing a sliding door in a closed position.
Figure 3:
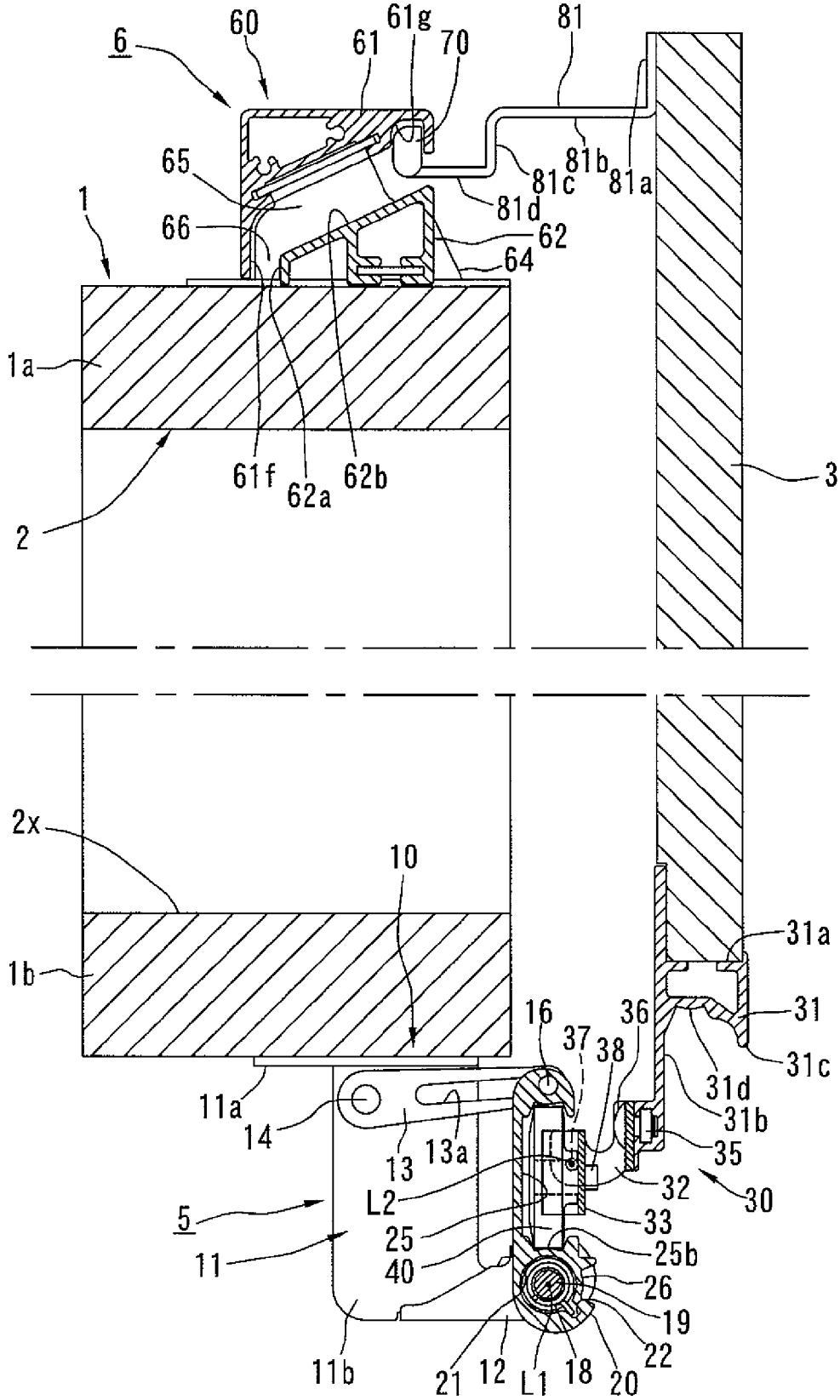
FIG. 3 is an enlarged vertical sectional view of the guide apparatus, showing the sliding door in an opening preparation position.
Figure 4:
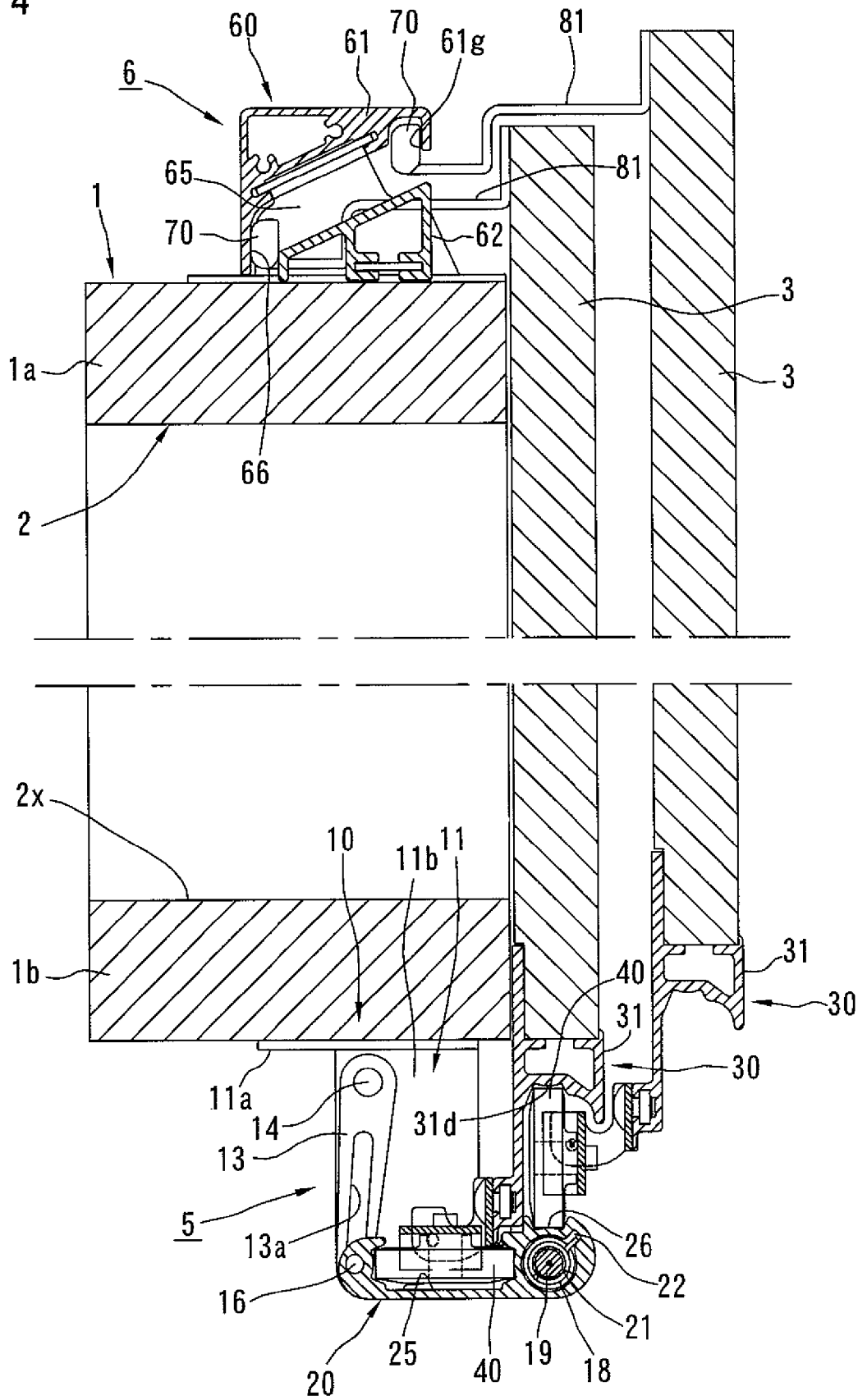
FIG. 4 is an enlarged vertical sectional view of the guide apparatus, showing one sliding door in the closed position and another sliding door in an open position, with these sliding doors overlapping each other.

The four rotatable rails 20 elongatedly extend in a right and left direction and are arranged in a straight line. As shown in FIGS. 2 through 4, each of the rotatable rails 20 is rotatably supported by a rail support mechanism 10 about a first rotation axis (L1).

The rail support mechanism 10 comprises a pair of left and right support brackets 11 disposed for each of the opening section 2*x*, separated generally by a width of the opening section 2*x*, and support blocks 12 mounted on the support brackets 11. The support brackets 11 cooperate with the support blocks 12 to serve as a rail support part.

Figure 10:
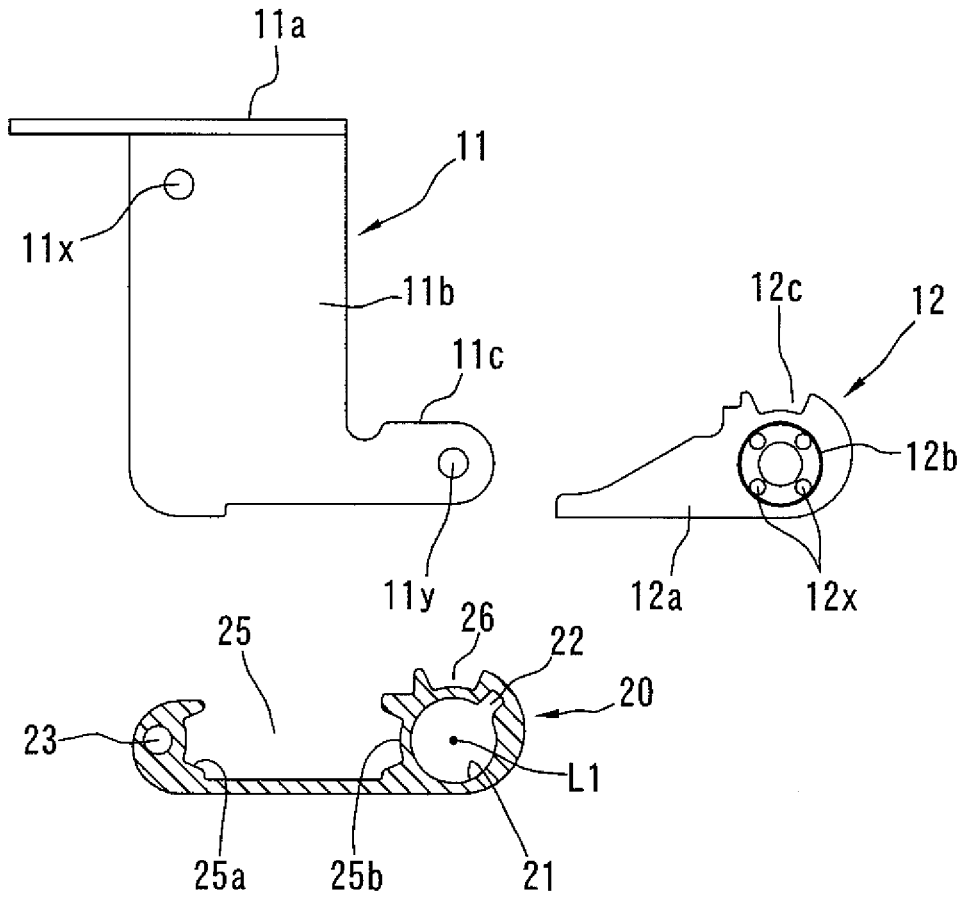
FIG. 10 is an exploded side view of the rotatable rail and a support mechanism therefor.

As shown in FIG. 10, the support bracket 11 is formed by bending a metal plate and includes a horizontal attachment portion 11*a* attached on a lower surface of the lower frame portion 1*b*, a vertical portion 11*b* vertically extending from the horizontal attachment portion 11*a* and a projection 11*c* projecting horizontally forward (front side in FIG. 1, right side in FIGS. 2 to 4) from the vertical portion 11*b*. The support brackets 11 for adjoining opening sections 2*x* are placed in proximity to each other in back-to-back relation.

Figure 11:
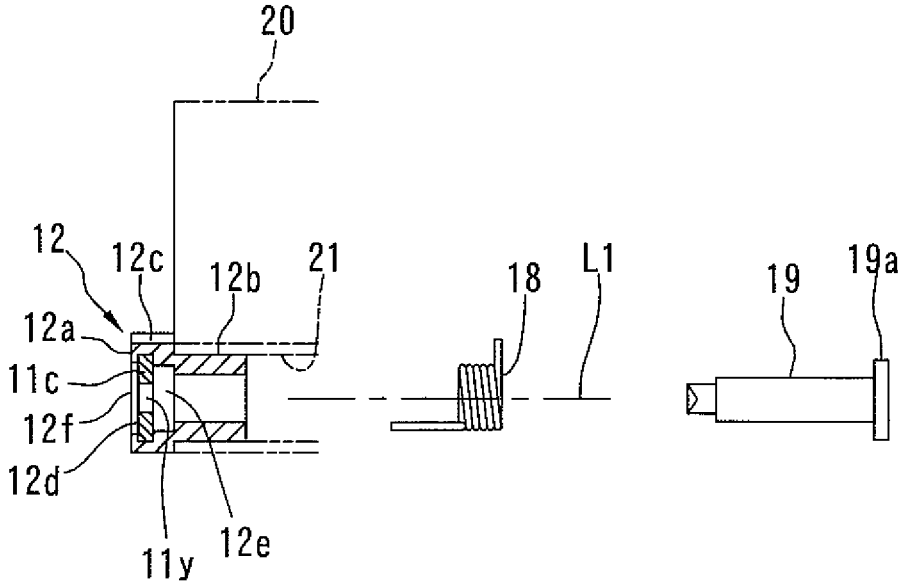
FIG. 11 is an exploded front view, partly shown in cross-section, of the support mechanism for the rotatable rail and a torsion spring.

As shown in FIGS. 10 and 11, the support block 12 having an elongated configuration is supported at the projection 11*c* of the support bracket 11. The support block 12 includes a body 12*a*, a bearing portion 12*b* having a cylindrical configuration and extending from a side surface of one end portion of the body 12*a* and a track portion 12*c* formed in a top surface of the one end portion of the body 12*a*. As shown in FIG. 11, a slit 12*d* is formed in the body 12*a* and the projection 11*c* of the support bracket 11 is inserted in the slit 12*d*. The slit 12*d* communicates with an inner space of the bearing portion 12*b* through a hole 12*e* and opens to a side surface of the body 12*a* on the opposite side to the bearing portion 12*b* through a hole 12*f*.

As shown in FIG. 10, a support hole 11*x* is formed in an upper and rear end of the vertical portion 11*b* of the support bracket 11. As shown in FIGS. 2 to 4, one end portion of an arm 13 (stop member) is rotatably connected to the support bracket 11 via a pin 14 inserted in the support hole 11*x*. The arm 13 is formed in an elongated configuration and includes a slit 13*a* extending in a longitudinal direction thereof. The slit 13*a* extends up to the other end portion of the arm 13.

The rotatable rail 20 is, as shown in FIG. 10, formed of an extruded material such as an extruded aluminum having a flat cross-sectional configuration. The rotatable rail is formed in an elongated configuration horizontally extending in the right and left direction and having a length slightly shorter than a width of the sliding door 3. The rotatable rail 20 is formed in one end portion in a width direction thereof with a receiving hole 21 having a circular cross-sectional configuration and extending in a longitudinal direction and a catch groove 22 communicating with an inner periphery of the receiving hole 21.

As shown in FIG. 11, the bearing portions 12*b* of the support blocks 12 are fitted into the receiving hole 21 at opposite ends of the rotatable rail 20, thereby making the rotatable rail 20 rotatably supported by the support blocks 12, and thus rotatably supported by the lower frame 1*b*. As shown in FIG. 2, the rotation axis L1 of the rotatable rail 20 is located forward of the frame 1.

As shown in FIG. 10, a hole 23 is formed in the other end portion of the rotatable rail 20 opposite to the rotation axis L1. As shown in FIGS. 2 to 4, via a pin 16 passing through the hole 23 and the slit 13*a* of the arm 13, the other end portion of the rotatable rail 20 is connected to the arm 13 such that the rotatable rail 20 is rotatable with respect to the arm 13 and slidable in a longitudinal direction of the arm 13.

The pin 16 is caught at a distal end of the slit 13*a* of the arm 13, thereby making the rotatable rail 20 caught at a horizontal lying position (first rotation position) as shown in FIG. 2 and an vertical standing position (second rotation position). Sliding of the pin 16 in the slit 13*a* allows the rotatable rail 20 to rotate between the horizontal lying position and the vertical standing position.

As shown in FIGS. 2 to 4 and FIG. 11, the rotatable rail 20 is constantly biased toward the vertical standing position by a pair of right and left torsion springs 18 (biasing members). The torsion springs 18 are received in a receiving hole 21 of the rotatable rail 20. One end of the torsion spring 18 is inserted into and caught by a catch hole 12*x* formed in an end surface of the bearing portion 12*b* of the support block 12. The other end of the torsion spring is caught by the catch groove 22 of the rotatable rail 20.

As shown in FIG. 11, support pins 19 are also received in opposite ends of the receiving hole 21 of the rotatable rail 20. The support pin 19 passes through the bearing portion 12*b* of the support block 12 and the torsion spring 18. One end portion of the support pin 19 is fixed by caulking to a fixing hole 11*y* formed in a distal end portion of the projection 11*c* of the support bracket 11, thereby fixing the support block 12 to the support bracket 11.

The torsion spring 18 is disposed between a flange 19*a* formed at the other end of the support pin 19 and the end face of the bearing portion 12*b* and securely supported there.

As shown in FIG. 10, the rotatable rail 20 further includes a receiving groove 25 for receiving rollers 40. The receiving groove 25 extends in the longitudinal direction of the rotatable rail 20 and is open at opposite ends of the rotatable rail 20. The receiving groove 25 is also open at upper side when the rotatable rail 20 is in the horizontal lying position (front side when in the vertical standing position). As described later, a bottom surface (opposite side portions in a width direction of the bottom surface in this embodiment) of the receiving groove 25 is provided as support surfaces 25*a* for supporting the rollers 40 and a side surface of the receiving groove 25 near the rotation axis L1 is provided as a running track 25*b*.

An auxiliary track 26 is formed on the one end portion of the rotatable rail 20 near the rotation axis L1, at a location 90 degrees apart from the running track 25*b*. When the rotatable rail 20 is in the horizontal lying position as shown in FIG. 2, the auxiliary track 26 faces upward and becomes continuous with the track portions 12*c* of the support blocks 12. When the rotatable rail 20 is in the vertical standing position as shown in FIG. 3, the auxiliary track 26 faces forward.

As shown in FIGS. 2 to 4, the roller 40 has a flat disc-like configuration and is swingably supported by the sliding door 3 about a second rotation axis L2 via a roller support mechanism 30 (runner support mechanism). The second rotation axis L2 runs parallel to the first rotation axis L1.

The roller support mechanism 30 includes a support frame 31 and two pairs of brackets 32, 33. The support frame 31 is formed of an extruded material extending in a right and left direction and has a length equal to the width of the sliding door 3. The support frame 31 includes a fixed portion 31*a* fixed to the lower edge portion of the sliding door 3, a vertical portion 31*b* extending vertically from a rear edge of the fixed portion 31*a* and a handle portion 31*c* extending downward from a front edge of the fixed portion 31*a*. The handle portion 31*c* has a cross-sectional configuration suitable for a user to engage his or her fingers therein.

As described later, a receiving recess 31*d* for receiving an upper portion of the roller 40 is formed between the handle portion 31*c* and the vertical portion 31*b*. Since the support frame 31 is formed of the extruded material, the handle portion 31*c* and the receiving recess 31*d* extend in a longitudinal direction of the support frame 31 (right and left direction).

Figure 9:
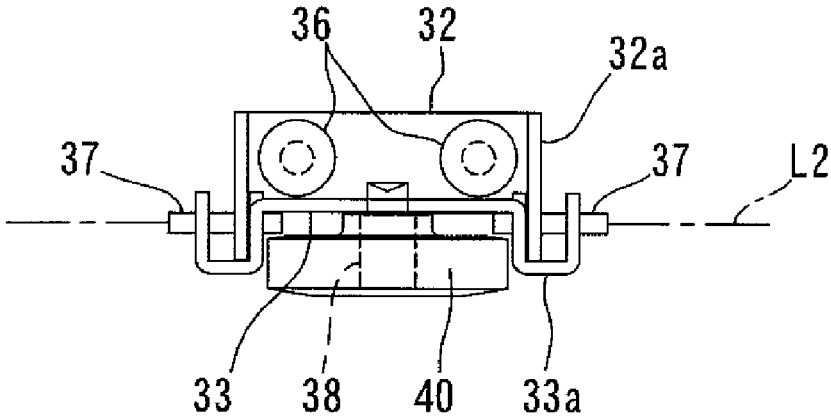
FIG. 9 is an enlarged rear view of a roller and a support mechanism therefor when the sliding door is in the closed position and the rotatable rail is in a horizontal lying position.

As shown in FIGS. 2 and 9, the vertical portion 31*b* of the support frame 31 extends further downward than the handle portion 31*c*, and a pair of left and right brackets 32 are fixed to a lower edge portion of the vertical portion 31*b*. To be more specific, a groove extending in the longitudinal direction is formed in the vertical portion 31*b*, and the brackets 32 are secured to the vertical portion 31*b* by means of nuts 35 received in the groove and screws 36.

As shown in FIG. 9, the brackets 32, 33 have support portions 32*a*, 33*a*, at opposite ends thereof. A pin 37 passes through the support portions 32*a*, 33*a*, thereby connecting the bracket 33 to the bracket 32 such that the bracket 33 is rotatable about the rotation axis L2.

The roller 40 is rotatably supported to a central portion of the bracket 33 via a shaft member 38. A rotation axis of the roller 40 is orthogonal to the rotation axis L2 of the bracket 33.

Figure 5:
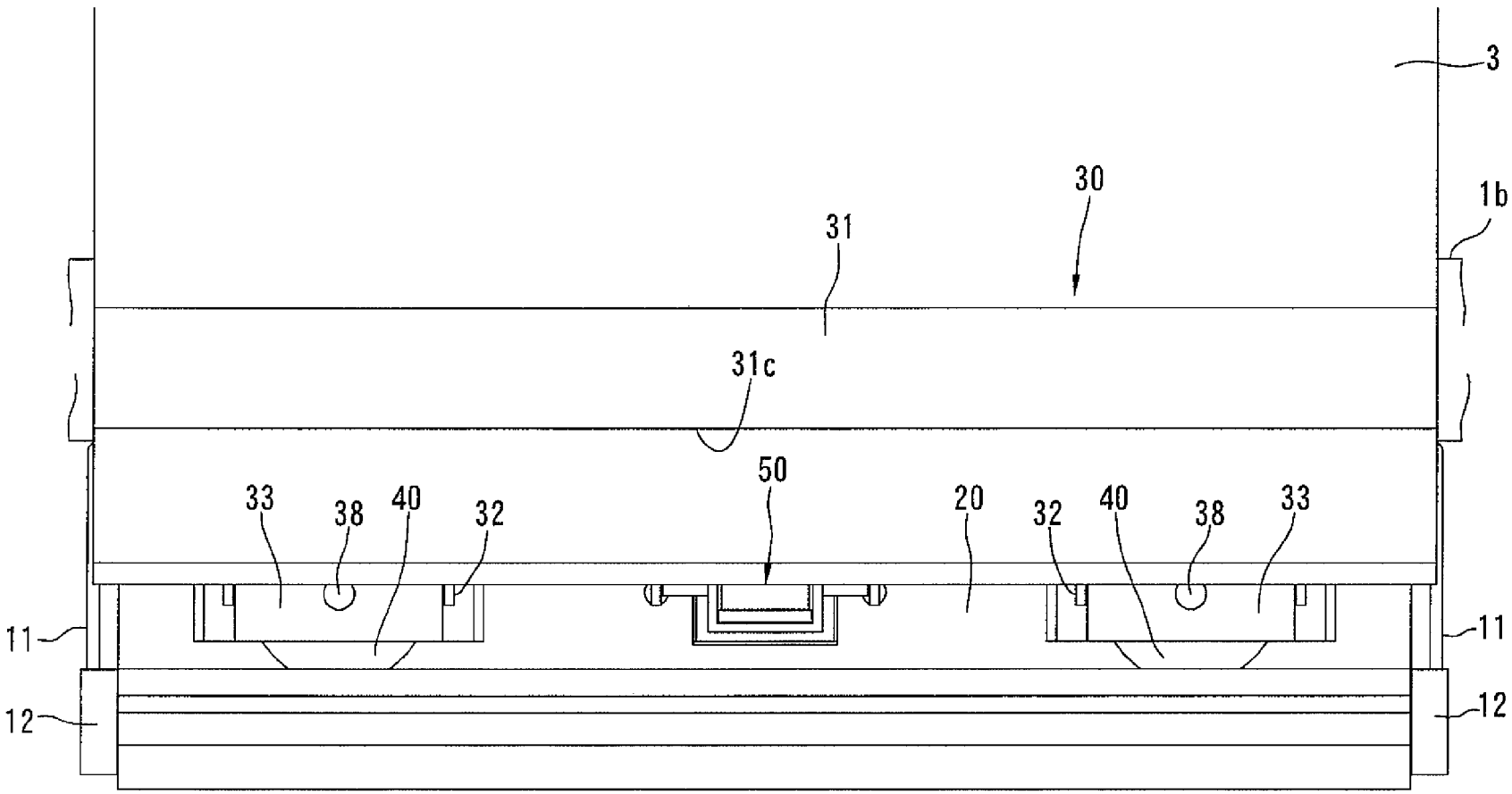
FIG. 5 is an enlarged front view of a lower structure of the guide apparatus showing a rotatable rail in an upright standing position and the sliding door in the opening preparation position.
Figure 6:
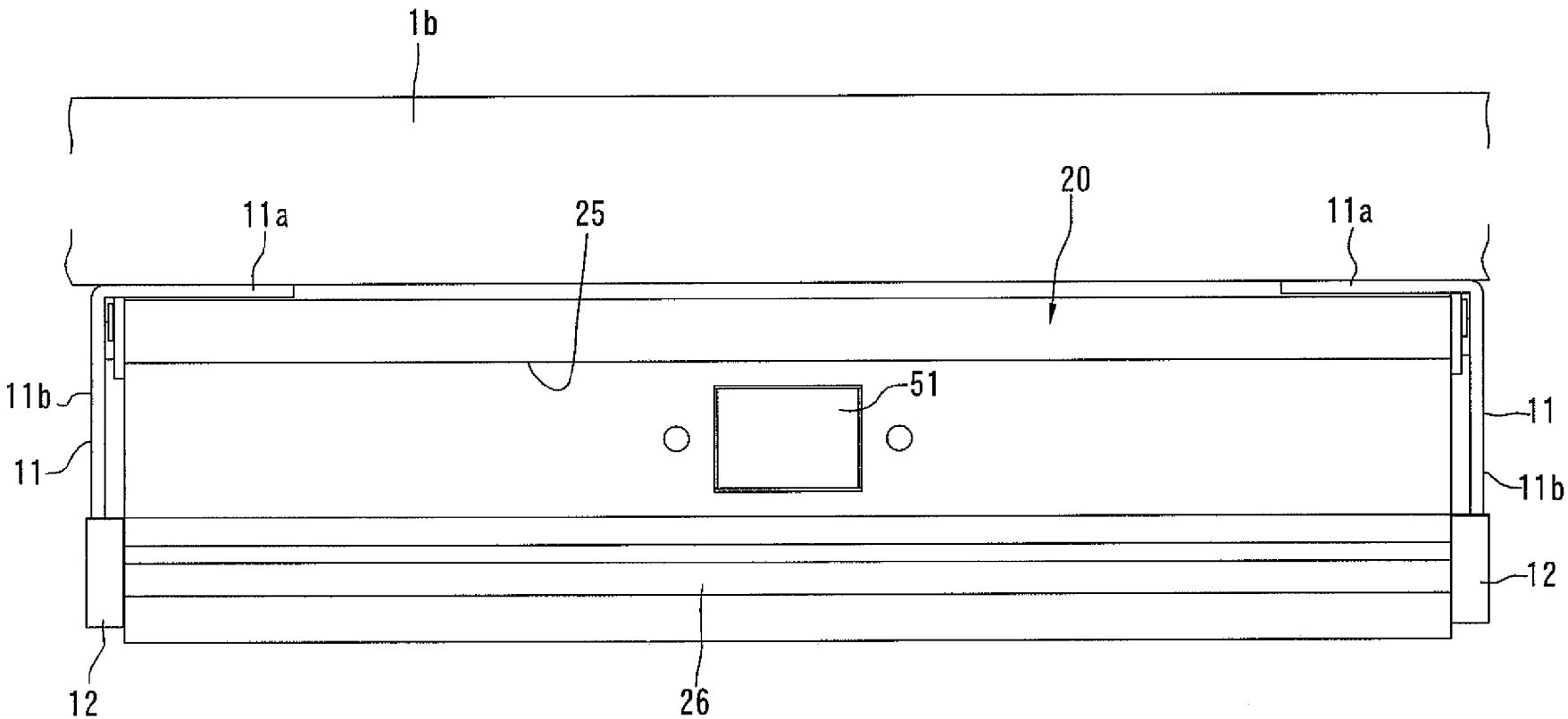
FIG. 6 is an enlarged front view of the lower structure of the guide apparatus showing the rotatable rail in the upright standing position and the sliding door in the open position.
Figure 7:
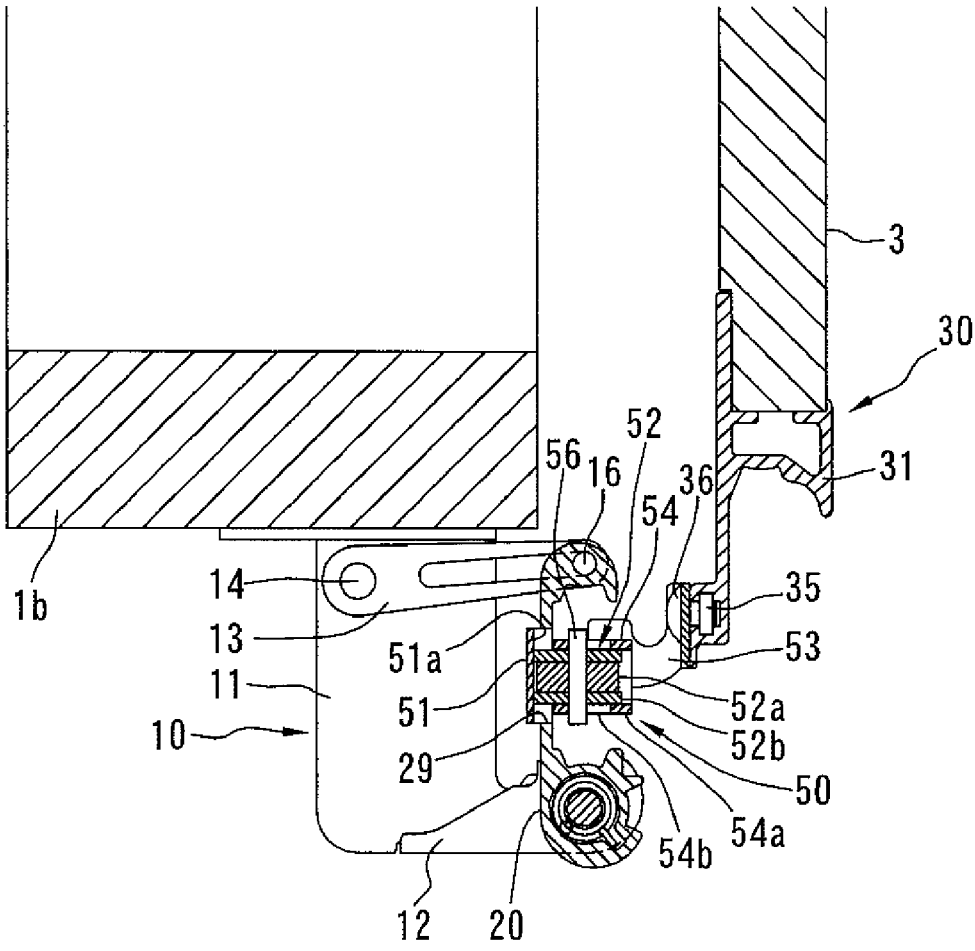
FIG. 7 is an enlarged cross-sectional view of a positioning mechanism when the sliding door is in the opening preparation position.
Figure 8:
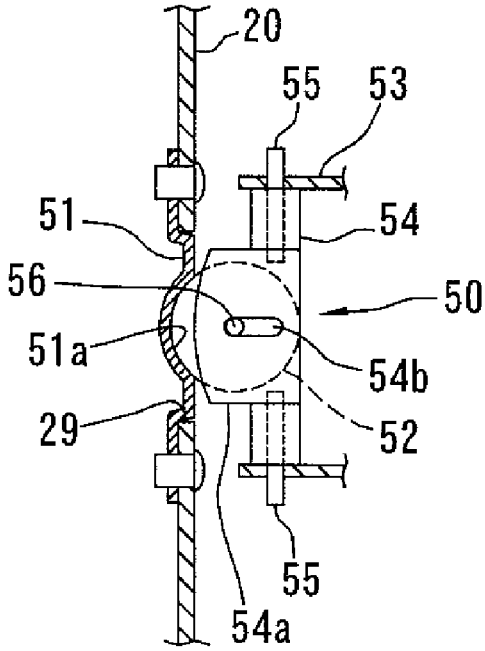
FIG. 8 is an enlarged plan view, partly shown in cross-section, of the positioning mechanism when the sliding door is in the opening preparation position.

As shown in FIG. 5, a positioning mechanism 50 is disposed between the pair of left and right rollers 40 in a central portion of the lower edge portion of the each of the sliding doors 3. The positioning mechanism 50 is provided for positioning the sliding door 3 with respect to the rotatable rail 20, and, as shown in FIGS. 7 and 8, includes a fitting plate 51 fixed to the rotatable rail 20 and a fitting roller 52 to be fitted into the fitting plate 51.

The fitting plate 51 is made of a magnetic material such as an iron plate and is fitted in a hole 29 formed in a central portion of the roatatble rail 20 and secured to the rotatable rail 20. The fitting plate 51 includes an arc-shaped fitting recess 51*a* in a central portion thereof.

The fitting roller 52 is supported by the support frame 31 via two brackets 53, 54. To be more specific, the bracket 53 is of a similar shape to the bracket 32 of the roller support mechanism 30 described earlier, and is fixed to the support frame 31 with a pair of the nut 35 and the screw 36. The bracket 54 is rotatably supported by the bracket 53 by means of pins 55 at opposite ends of the bracket 54. A rotation axis of the bracket 54 is on the same straight line as the rotation axis L2.

The fitting roller 52 is composed of a disk-shaped magnet 52*a* and a pair of disk-shaped support plates 52*b* arranged to sandwich the magnet 52*a*. A diameter of the support plate 52*b* is slightly larger than a diameter of the magnet 52*a*.

The fitting roller 52 is located between a pair of support plate portions 54*a* of the bracket 54. A pin 56 passes through a central portion of the fitting roller 52. Opposite end portions of the pin 56 are inserted in elongated holes 54*b* formed in the pair of the support plate portions 54*a*, thereby making the fitting roller 52 supported by the bracket 54 such that the fitting roller 52 can rotate with respect to and can project from and retract into the bracket 54. The pin 56 is arranged orthogonal to the pin 55.

An upper structure 6 (secondary guide mechanism) of the guide apparatus will be described hereinafter. The upper structure 6 includes, as shown in FIG. 2, a rail assembly 60 disposed on the upper frame portion 1*a* and sliders 70 disposed in an upper edge portion of the sliding door 3 via support brackets 81.

Figure 14:
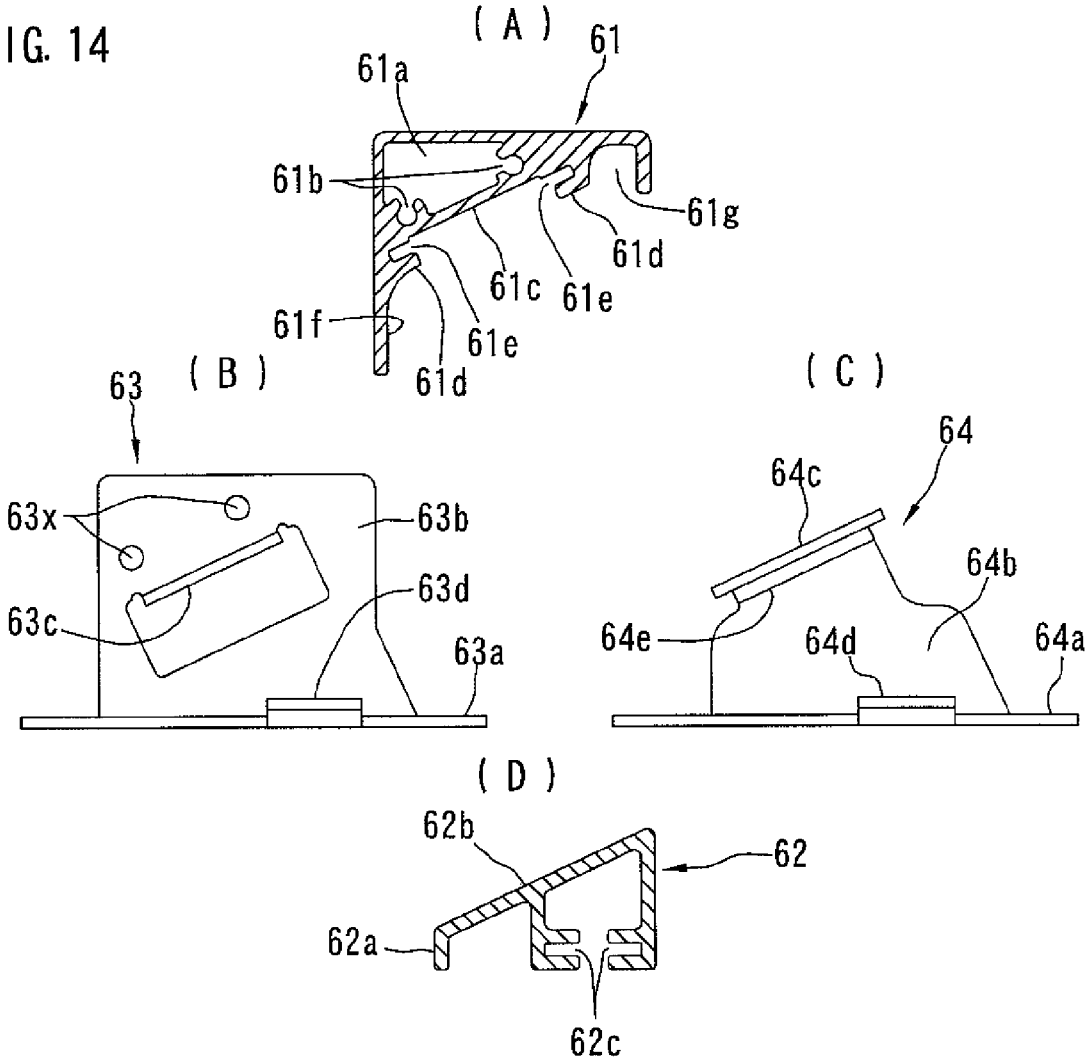
FIG. 14 shows each component of the upper structure of the guide apparatus.

The rail assembly 60 is, as shown in FIG. 14, composed of four kinds of elements, i.e. a first rail 61, second rails 62 and joint metals 63, 64.

Figure 12:
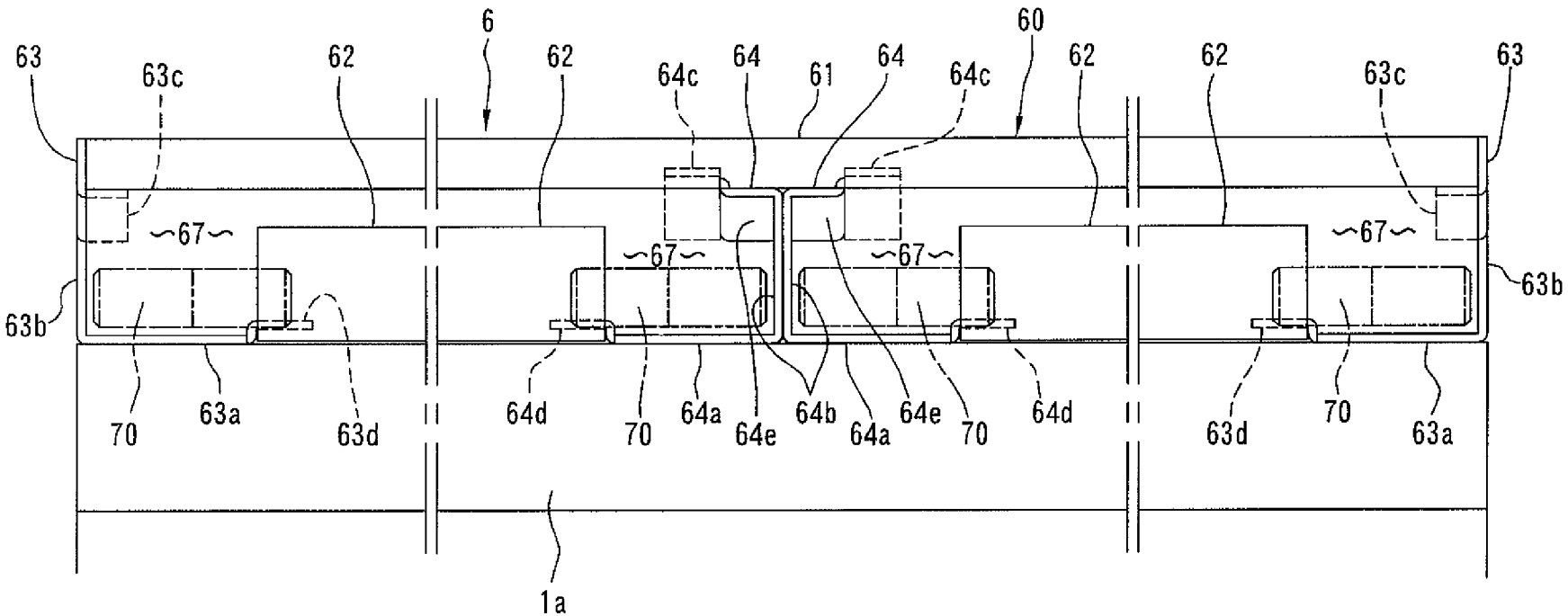
FIG. 12 is an enlarged front view of an upper structure of the guide apparatus.

As shown in FIGS. 1 and 12, the first rail 61 and the second rail 62 extend along the upper frame portion 1*a*. The first rail 61 has a length generally equal to the sum of the width of the four sliding doors 3 (length of the upper frame portion 1*a*. The second rail 62 is shorter than the width of a sliding door 3 and is disposed for each of the opening sections 2*x*.

As shown in FIGS. 2 and 14, the first rail 61 is made of an extruded material having a generally triangular cross-sectional configuration, and the second rail 62 is made of an extruded material having a generally trapezoidal cross-sectional configuration. The first rail 61 and the second rail 62 are arranged to face each other across an inclined gap 65 and together form a rectangular cross section. The gap 65 is inclined upward as it extends forward. Regions of the gap 65 corresponding to opposite end portions of the second rail 62 in the longitudinal direction thereof serve as first guide channels for the sliders 70 to be described later.

As shown in FIGS. 2 and 14(A), the first rail 61 includes a lightening hole 61*a* formed in a corner portion of the first rail, two tapping holes 61*b* communicating with the lightening hole 61*a*, an inclined surface 61*c* inclined in vicinity of the lightening hole 61*a*, a pair of projections 61*d* formed along opposite edges in a width direction of the inclined surface 61*c* and fitting grooves 61*e* defined between the projections 61*d* and the inclined surface 61*c*. The first rail 61 further includes an upright surface 61*f* in a rear side of the first rail and a guide groove 61*g* (second guide channel) in an upper end portion in a front side of the first rail 61.

As shown in FIGS. 2 and 14(D), a rear surface of the second rail 62 is formed as an upright surface 62*a* and an upper surface of the second rail 62 is formed as an inclined surface 62*b*. A pair of fitting grooves 62*c* are formed in a lower portion in a front side of the second rail 62. The inclined gap 65 is formed between the inclined surface 61*c* of the first rail 61 and the inclined surface 62*b* of the second rail 62. A gap 66 communicating with the inclined gap 65 is formed between the upright surface 61*f* of the first rail 61 and the upright surface 62*a* of the second rail 62. Opposite end portions of the gap 66 are provided as receiving recesses for the sliders 70 to be described later.

As shown in FIG. 12, opposite ends of the first rail 61 are fixed to the opposite ends of the upper frame portion 1*a* with the joint metals 63. As most clearly shown in FIGS. 14(B) and 15(A), the joint metal 63 is formed by bending a metal plate. The joint metal 63 includes a fixing plate portion 63*a* horizontally extending and to be fixed to a top surface of the upper frame portion 1*a*, a vertical attachment plate portion 63*b* bent 90 degrees with respect to the fixing plate portion 63*a*, a first fitting plate portion 63*c* formed by cutting and bending 90 degrees a portion of the attachment plate portion 63*b* and a second fitting plate portion 63*d* extending from an edge of the fixing plate portion 63*a* in the opposite side to the attachment plate portion 63*b*. The first fitting plate portion 63*c* is inclined. The second fitting plate portion 63*d* extends horizontally and is located higher than the fixing plate portion 63*a* above the top surface of the upper frame portion 1*a*.

Each of the opposite ends of the first rail 61 is fixed to the upper frame portion 1*a* via the joint metal 63 by fitting the first fitting plate portion 63*c* into the space between the pair of projections 61*d* of the first rail 61 and by screwing screws into end portions of the tapping holes 61*b* through holes 63*x* formed in the attachment plate portion 63*b*.

Figure 15:
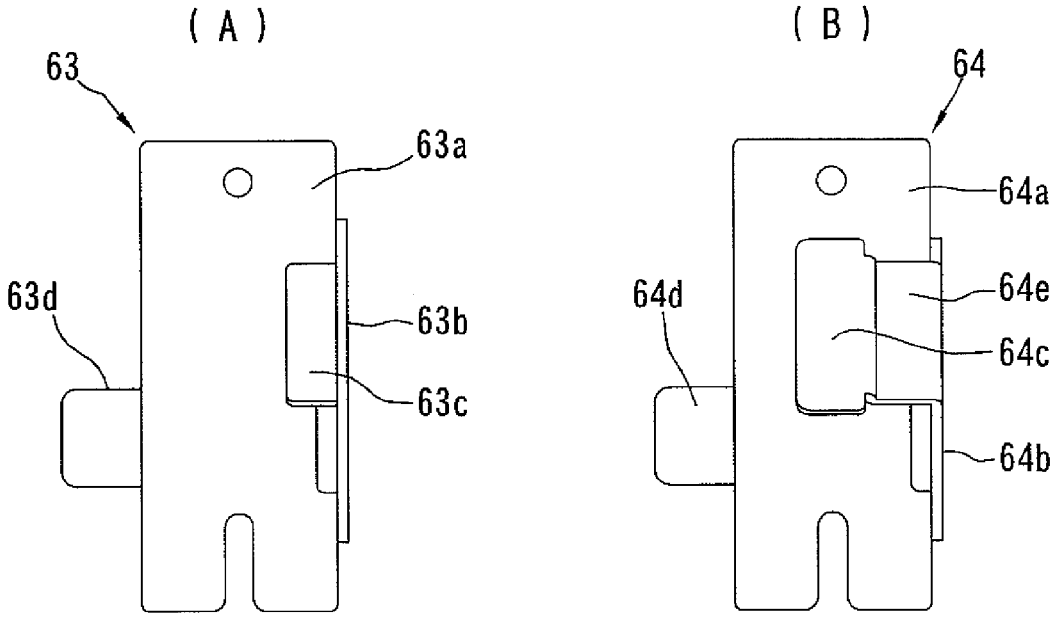
FIG. 15(A) is a plan view of the joint metal disposed at the opposite ends of the first rail.
FIG. 15(B) is a plan view of the joint metal disposed in the intermediate portion of the first rail.

As shown in FIG. 12, the first rail 61 is supported by the upper frame 1*a* via other joint metals 64 in an intermediate portion of the first rail 61. As shown in FIGS. 14(C) and 15(B), the joint metal 64, as with the joint metal 63, includes a fixing plate portion 64*a* to be fixed to the upper frame portion 1*a*, an attachment plate portion 64*b*, a first fitting plate portion 64*c* and a second fitting plate portion 64*d*. However, the attachment plate portion 64*b* of the joint metal 64 is smaller than the attachment plate portion 63*b* of the joint metal 63 and does not have a portion extending higher than the fitting plate portion 64*c* so that the attachment plate portion 64*b* may not interfere with the first rail 61. The first fitting plate portion 64*c* is continuous with the attachment plate portion 64*b* via an insertion plate portion 64*e* located slightly lower than the first fitting plate portion 64*c*.

As shown in FIGS. 2 and 12, the intermediate portion of the first rail 61 is supported by fitting the first fitting plate portions 64*c* of the joint metals 64 into the fitting groove 61*e* of the first rail 61. In this fitted condition, the insertion plate portion 64*e* of the joint metals 64 is inserted between the projections 61*d* of the first rail 61.

Support mechanism for the second rails 62 will be described now with reference to FIGS. 2 and 12. The second rails 62 located in the right and left ends of the upper frame portion 1*a* are supported by different kinds of the joint metals 63, 64 sandwiching the second rails 62. The second fitting plate portions 63*d*, 64*d* of the joint metals 63, 64 are fitted into opposite end portions of the fitting groove 62*c* of the second rail 62.

The second rail 62 in the middle is supported by one kind of the joint metals 64, 64 sandwiching the second rails 62. The second fitting plate portions 64*d*, 64*d* of the joint metals 64, 64 are fitted into the opposite end portions of the fitting groove 62*c* of the second rail 62.

A pair of the joint metals 63, 64 or the joint metals 64, 64, paired for each opening section 2*x*, in other words, for each sliding door 3, are separated by a distance generally same as the width of the sliding door 3. The joint metals 64, 64 for the adjoining opening sections 2*x* are located back to back with the attachment plate portions 64*b*, 64*b* contacting each other.

As mentioned above, since the length of the second rail 62 is shorter than the width of the opening section 2*x* and the width of the sliding door 3, as shown in FIG. 12, a receiving space 67 is formed between the opposite ends of the second rail 62 and the attachment plate portions 63*b*, 64*b* of the joint metals 63, 64.

Steps for installing the rail assembly 60 will now be described. Firstly, the first fitting plate portions 64*c* of all (six in this embodiment) of the joint metals 64 are inserted into the fitting groove 61*e* of the first rail 61 from one end or opposite ends of the fitting groove 61*e*. The joint metals 64 are located in the intermediate portion of the first rail 61 spaced from each other. The first fitting plate portion 63*c* of one of the joint metals 63 is fitted into the space between the pair of projections 61*d* of the first rail 61 and the joint metal 63 is fixed to one end of the first rail 61 with screws.

Secondly, all of the second rails 62 are joined to the first rail 61 by inserting the second fitting plate portions 63*d*, 64*d* of the joint metals 63, 64 into the opposite ends of the fitting groove 62*c* of the second rail 62. At this time, the second rail 62 located at the other end side of the first rail 61 is supported by the joint metal 64 only at a one end.

Lastly, another joint metal 63 is fixed to the other end side of the first rail 61. At the same time, the second fitting plate portion 63*d* of the joint metal 63 is inserted into the other end side of the fitting groove 62*c* of the second rail 62.

The rail assembly 60 is assembled in the above described manner. The assembly can be done in different orders. For example, firstly the joint metal 63 may be fixed to the one end of the first rail 61, secondly the second rails 62 and the pair of joint metals 64 may be alternately joined to the first rail 61, and lastly the joint metal 63 may be fixed to the other end of the first rail 61.

The rail assembly 60 assembled in the above described manner is positioned on the upper frame portion 1*a*, and the fixing plate portions 63*a*, 64*a* of the joint metals 63, 64 are fixed to the upper surface of the upper frame portion 1*a* with screws. The rail assembly 60 has the one long first rail 61, and the other components are attached to the first rail 61. This construction makes it easy to position all the components because each component just has to be positioned with respect to the first rail 61. This construction also makes mounting work easy since the rail assembly 60 has been assembled beforehand.

Figure 13:
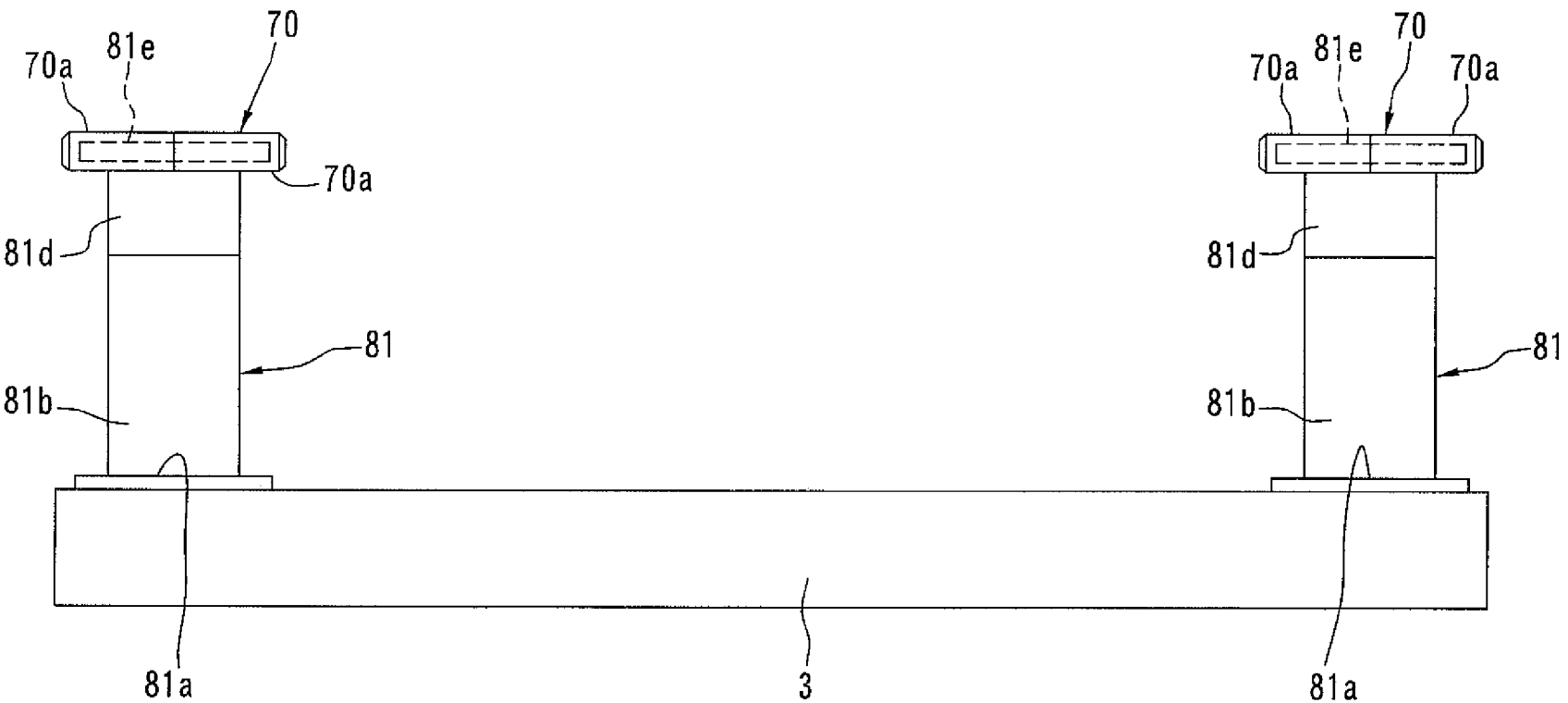
FIG. 13 is a plan view of the sliding door.

As shown in FIGS. 3 and 13, the support brackets 81 are fixed on right and left ends of the upper edge portion of the sliding door 3. The support bracket 81 is formed by bending a metal plate and includes a fixing plate portion 81*a* to be fixed to the rear surface of the sliding door 3, a first horizontal portion 81*b* horizontally extending rearward from a lower edge of the fixing plate portion 81*a*, a vertical portion 81 vertically extending downward from a rear edge of the first horizontal portion 81*b*, a second horizontal portion 81*d* horizontally extending rearward from a lower edge of the vertical portion 81*c* and an upstanding portion 81*e* vertically upstanding from a rear edge of the second horizontal portion 81*d*. Right and left ends of the upstanding portion 81*e* are projecting.

The horizontal portions 81*b*, 81*d* and the vertical portion 81*c* of the support bracket 81 are of the same width and are adopted to be received in and exit from the receiving space 67 of the rail assembly 60 as will be described later.

A pair of half bodies of the slider 70 are attached to the upstanding portion 81*e* of the support bracket 81. The slider 70 extends horizontally parallel to the first rail 61. Opposite end portions 70*a* of the slider 70 project in a right and left direction from the support bracket 81. The slider 70 is slightly longer than the receiving space 67 in the right and left direction.

Operation of the guide apparatus having the above mentioned construction will now be described. Firstly, as shown in FIGS. 1 and 2, when all of the four opening sections 2*x* are closed by the sliding doors 3, the upper and lower edge portions of the sliding door 3 are respectively abutted against or in close vicinity via a slight clearance to front surfaces of the upper and lower frame portions 1*a*, 1*b* of the frame 1. Front surfaces of all the sliding doors 3 arranged in the right and left direction are located in the same vertical plane and flush with each other.

When the sliding door 3 is in a closed position (set position) as described above, in the lower structure 5, the rotatable rail 20 is in the horizontal lying position (first rotation position), and the rollers 40 are also horizontally down and received in the receiving groove 25 of the rotatable rail 20. Weight of the sliding door 3 is received by the rotatable rail 20 via the roller support mechanism 30 and the rollers 40. In the horizontal lying position, the gravity of the sliding door 3 acts at points where the support surfaces 25*a* of the receiving groove 25 and the rollers 40 are abutted. These abutment points are located rearward of the rotation axis L1 of the rotatable rail 20, and accordingly, a moment in a counterclockwise direction in FIG. 2 is applied to the rotatable rail 20. Since the counterclockwise moment is greater than a clockwise moment due to the elastic force of the torsion springs 18, the rotatable rail 20 attempts to rotate in the counterclockwise direction. However, the rotatable rail 20 is maintained in the horizontal lying position because it is caught by the arm 13. The rotatable rail 20 is also maintained in the horizontal lying position by abutment of a projection in the rear of the auxiliary track 26 against the vertical portion 31*b* of the support frame 31.

When all the sliding doors 3 are in the closed position, the auxiliary tracks 26 of all the rotatable rails 20 are arranged in one straight line to form a continuous track.

When the sliding doors 3 are in the closed position, in the upper structure 6, the support brackets 81 are received in the receiving space 67 of the rail assembly 60, and either right or left end portion of the slider 70 is received in the end portion of the gap 66 (receiving recess). This arrangement prohibits the upper end portion of the sliding door 3 from moving in the front and rear direction.

Opening movement of selected one of the sliding doors 3 will now be described. The handle portion 31*c* of the support frame 31 is grabbed and the sliding door 3 is pulled out to an opening preparation position located in the front. When the sliding door 3 is pulled out, as shown in FIG. 3, the rollers 40 engage the receiving groove 25 of the rotatable rail 20, thereby making the rotatable rail 20 rotated 90 degrees forward about the rotation axis L1 to take the vertical standing position (second rotation position). At this time, the rollers 40 also swing 90 degrees about the rotation axis L2 to take the vertical standing position. This makes the rollers 40 ride on the running track 25*b* of the receiving groove 25 of the rotatable rail 20.

To pull out the sliding door 3 to the opening preparation position as mentioned above, a force greater than the moment due to the weight of the sliding door 3 is initially required. The moment due to the weight of the sliding door 3 is reduced, however, as the sliding door 3 is pulled closer to the opening preparation position. At some point, the clockwise moment due to the torsion springs 18 becomes greater than the moment due to the weight of the sliding door 3, causing the sliding door 3 to be automatically moved to the opening preparation position.

When the rotatable rail 20 is in the standing position, the running track 25*b* is located just above the rotation axis L1, and therefore, no moment is generated by the weight of the sliding door 3. Although the clockwise moment due to the elastic force of the torsion springs 18 is applied to the rotatable rail 20, the rotatable rail 20 is maintained in the standing position since it is caught or stopped by the arm 13.

The rotation axis L2 of the rollers 40 moves upward from the position generally just beside the rotation axis L1 of the rotatable rail 20. Accordingly, the sliding door 3 is displaced upward as it is moved to the opening preparation position.

As mentioned above, when the sliding door 3 is moved from the closed position to the opening preparation position, it is displaced upward as it is moved forward. This causes either the left or the right end portion of the sliders 70 to escape from the gap 66, move obliquely along an end portion (the first guide channel) of the oblique gap 65, and finally enter the guide groove 61*g* (second guide channel).

Next, the sliding door 3 is moved from the opening preparation position to an open position (non-set position) either to the left or the right. At this time, as shown in FIG. 4, the rollers 40 of the sliding door 3 run on the running track 25*b* of the corresponding rotatable rail 20 in the standing position and transfer onto the auxiliary track 26 of another rotatable rail 20 (adjacent rotatable rail or member) adjacent to the corresponding rotatable rail 20.

While the sliding door 3 is moved to the opening position as described above, the sliders 70 of the sliding door 3 run in the guide groove 61*g* of the first rail 61.

As shown in FIG. 4, when the sliding door 3 is in the open position, the rollers 40 run on the auxiliary track 26. The upper portions of the rollers 40 are received in the receiving recess 31*d* formed in the support frame 31 of the sliding door 3 in the closed position, thereby the rollers 40 are surely prevented from falling off.

As shown in FIG. 4, the sliding door 3 in the open position is overlapped with one of the other sliding doors 3 in the closed position. The sliding door 3 can move from the left end to the right end of the frame 1.

The rotatable rail 20 left by the sliding door 3 that has moved to the open position is maintained in the standing position by a holding mechanism composed of the torsion springs 18 and the arms 13. This enables the sliding door 3, when it returns to the opening preparation position from the open position, to smoothly transfer from the auxiliary track 26 of the adjacent rotatable rail 20 in the lying position onto the running track 25*b* of the corresponding rotatable rail 20 in the standing position.

Even if the rotatable rail 20 is slightly rotated toward the horizontal lying position by an external force applied to the sliding door 3, the rotatable rail 20 can be returned to the standing position by the elastic force of the torsion springs 18.

When the sliding door 3 returns to the opening preparation position, the sliding door 3 is positioned by the positioning mechanism 50. To be more specific, the fitting roller 52 mounted on the bracket 54 of the sliding door 3 is moved to be fitted into the fitting recess 51*a* of the fitting plate 51 of the rotatable rail 20 by the magnetic force acting between the magnet 52*a* of the fitting roller 52 and the fitting plate 51. As a result, the sliding door 3 is positioned to the same location with the rotatable rail 20 in the right and left direction.

To return the sliding door 3 from the opening preparation position to the closed position, the sliding door 3 should be pushed toward the frame 1 against the torsion springs 18. At some point, the counterclockwise moment due to the weight of the sliding door 3 becomes greater than the clockwise moment due to the torsion springs 18, causing the sliding door 3 to be automatically returned to the closed position with the rotatable rail 20 and the rollers 40 returned to the horizontal lying positions as shown in FIG. 2.

Figure 16:
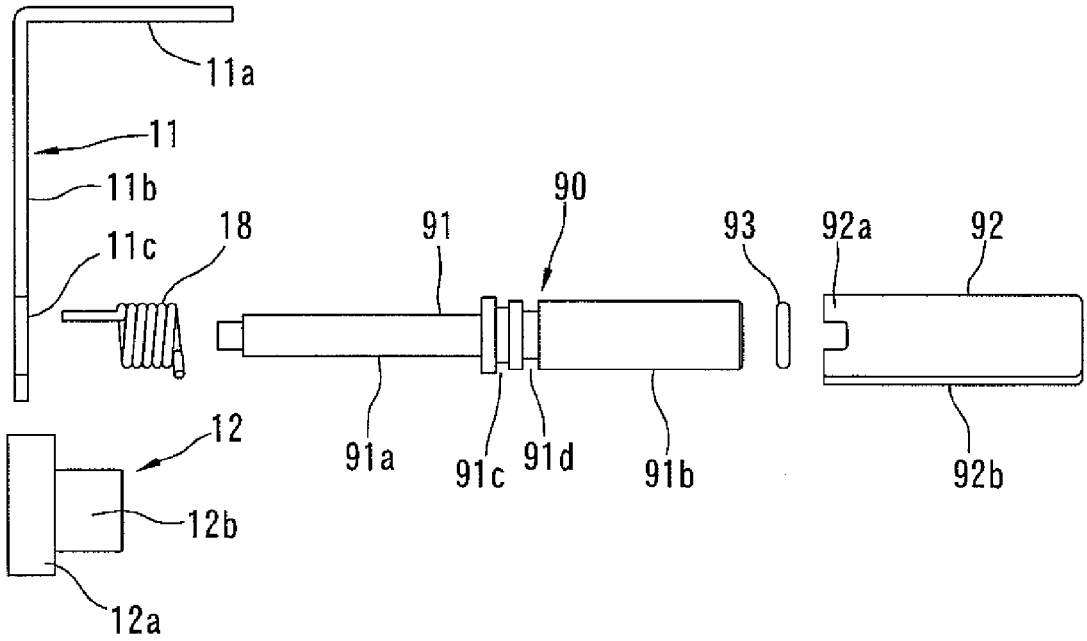
FIG. 16 is an exploded front view of a support mechanism for a rotatable rail and a torsion spring of a guide apparatus according to a second embodiment of the present invention.
Figure 17:
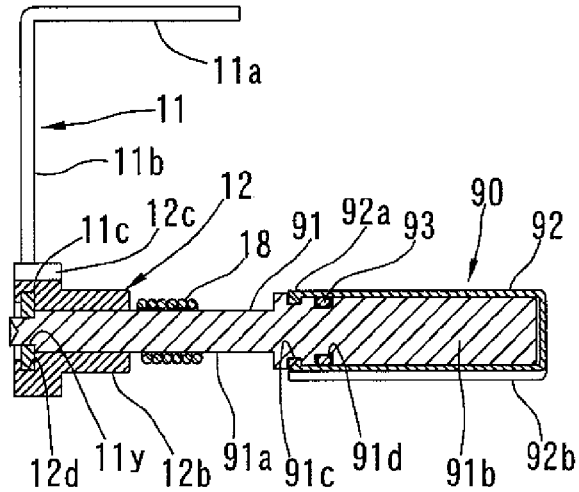
FIG. 17 is an assembled cross-sectional view of the support mechanism for the rotatable rail and the torsion spring of the guide apparatus according to the second embodiment of the present invention.
Figure 18:
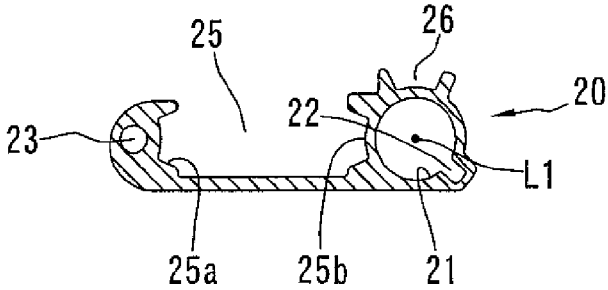
FIG. 18 is a cross-sectional view of the rotatable rail used in the second embodiment.

A second embodiment of the present invention will now be described with reference to FIGS. 16 to 18. Same reference numerals are used to designate elements corresponding to those in the first embodiment and detailed explanations are omitted for such elements.

In the second embodiment, a known damper 90, in place of the support pin 19 of the first embodiment, is received in a receiving hole 21 of a rotatable rail 20. The damper 90 includes a shaft 91 and a tubular member 92 having a bottom in one end of the tubular member 92.

The shaft 91 integrally includes a pin portion 91*a* and an operation portion 91*b* having a greater diameter than and arranged coaxially with the pin portion 91*a*. As with the support pin 19 of the first embodiment, the pin portion 91*a* passes through a torsion spring 18 and a support block 12. A reduced-diameter distal end portion of the pin portion 91*a* passes through a fixing hole 11*y* of a support bracket 11 and caulked, thereby making the shaft 91 non-rotatably fixed to the support bracket 11.

The pin portion 91*a* of the shaft 91 is passed through the torsion spring 18. The torsion spring 18 is located between a bearing portion 12*b* and the operation portion 91*b*.

A catch groove 91*c* and a receiving groove 91*d*, both having annular configuration, are formed in an outer periphery of an end portion of the operation portion 91*b* of the shaft 91 near the pin portion 91*a*.

In the tubular member 92, a plurality of pawls 92*a* are formed at an opening end of the tubular member. The pawls 92*a* are arranged spaced away in a circumferential direction. The pawl 92*a* is caught by the catch groove 91*c* of the shaft 91, thereby the tubular member 92 is attached to the shaft 91.

A slight gap is formed between the outer periphery of the operation portion 91*b* of the shaft 91 and an inner periphery of the tubular member 92. Viscous fluid is filled in the gap. A scaling ring 93 is received in the receiving groove 91*d* of the shaft 91. The sealing ring 93 prohibits the viscous fluid from leaking out.

A projection 92*b* extending in an axial direction is formed in an outer periphery of the tubular member 92. In the rotatable rail 20, as shown in FIG. 18, a catch groove 22 extending in the longitudinal direction of the rotatable rail 20 is formed. The projection 92*b* of the tubular member 92 is received in the catch groove 22. As a result, the tubular member 92 is prevented from rotating with respect to the rotatable rail 20 and moves in unison with the rotatable rail 20.

As a sliding door 3 moves from an opening preparation position to a closed position, the rotatable rail 20 rotates from a standing position to a lying position. This makes the tubular member 92 of the damper 90 rotate relative to the shaft 91. During this relative rotation, a damper effect is provided by the resistance of viscous fluid interposed between the operation portion 91*b* and the tubular member 92. Accordingly, increase in rotational speed of the rotatable rail 20 due to a weight of the sliding door 3 is restrained, making it possible to avoid impact of the rotatable rail 20 reaching the lying position.

Although particular embodiments of the invention have been described in detail for purposes of illustration, various modifications and enhancements may be made without departing from the spirit and scope of the invention. For example, a primary guide mechanism and a secondary guide mechanism having a similar structure to those used in the above embodiments may be mounted upside down in vertically swapped locations.

Application of the sliding door and the guide apparatus is not limited to the partition. They may be used for opening and closing an opening of a window of a house or an opening of furniture.

The torsion spring may be located only at one end of the rotatable rail.

The rail support part may be formed as an integral part of the main body.

The guide apparatus may be used for a single sliding door 3. In this case, a fixed rail (adjacent rotatable rail or member) may be arranged adjacent to the rotatable rail. The fixed rail may have an auxiliary track to be continuous in a straight line with the running track of the rotatable rail in the standing position.

INDUSTRIAL APPLICABILITY

This invention may be applied to a guide apparatus for plate-like objects such as a partition, furniture, a sliding door in window, etc.

The invention claimed is:

1. A guide apparatus for guiding a movement of each of a plurality of sliding doors with respect to a main body between a set position and a preparation position in front of or behind the set position, and between the preparation position and a non-set position to the left or right of the preparation position, said plurality of sliding doors being flush with each other when all of said plurality of sliding doors are in the set positions and arranged in a right and left direction, said guide apparatus comprising:

a plurality of rotatable rails formed in an elongated shape horizontally extending in a right and left direction, arranged in the right and left direction to form a straight line and supported by said main body such that each of said rotatable rails can rotate about a first rotation axis extending in the right and left direction between a first rotation position and a second rotation position; and a runner supported by each of said plurality of sliding doors such that said runner can swing about a second rotation axis parallel to said first rotation axis;

wherein each of said rotatable rails includes a receiving groove extending in a longitudinal direction of said rotatable rail, a one side portion of said receiving groove being provided as a running surface;

wherein each of said rotatable rails further includes an auxiliary surface spaced from said running surface by the same angle as the angle between the first rotation position and the second rotation position about said first rotation axis;

wherein when each of said sliding doors is in the set position, corresponding one of said rotatable rails is in the first rotation position and said runner is received in said receiving groove of said corresponding rotatable rail;

wherein when each of said sliding doors is in the preparation position, corresponding one of said rotatable rails is in the second rotation position and said runner is received in said receiving groove and rides on said running surface of said corresponding rotatable rail;

wherein when each of said sliding doors is moved from the preparation position to the non-set position, said runner is capable of transferring from said running surface of said corresponding rotatable rail onto said auxiliary surface of another of said rotatable rails adjacent to said corresponding rotatable rail;

wherein said guide apparatus further comprises:

a biasing member biasing each of said rotatable rails toward the second rotation position; and a stop member for maintaining each of said rotatable rails at the second rotation position against said biasing member;

wherein said rotatable rail includes a receiving hole opening at left and right ends of the rotatable rail;

wherein a pair of rail support parts are mounted on said main body in such a manner as to sandwich said rotatable rail and rotatably support said rotatable rail, each of said rail support parts including a bearing portion fitted into said receiving hole of said rotatable rail; and wherein said biasing member is received in said receiving hole at a location deeper than said bearing portion.

2. The guide apparatus for a sliding door according to claim 1 wherein: said biasing member comprises a torsion spring, one end of said torsion spring being caught in an end surface of said bearing portion, the other end of said torsion spring being caught in an inner periphery of said receiving hole.

3. The guide apparatus for a sliding door according to claim 2 wherein:

a support pin having a flange at a distal end thereof is secured to said rail support part, said support pin projecting from an end surface of said bearing portion along said first rotation axis, said support pin passing through said torsion spring inside said receiving hole of said rotatable rail, said torsion spring being arranged between said bearing portion and said flange of said support pin; and a catch groove extending in a longitudinal direction of said rotatable rail is formed in said inner periphery of said receiving hole of said rotatable rail, said other end of said torsion spring being inserted in said catch groove.

4. The guide apparatus for a sliding door according to claim 2 further comprising:

an elongated damper received in said receiving hole of said rotatable rail, said damper including a shaft, a tubular member placed over an outer periphery of said shaft and viscous resistance material filling a gap between said outer periphery of said shaft and an inner periphery of said tubular member;

wherein said shaft is fixed to said rail support part and projects from said end face of said bearing portion along said first rotation axis, said shaft passing through said torsion spring; and wherein said tubular member is prevented from rotating with respect to said inner periphery of said receiving hole of said rotatable rail.

5. The guide apparatus for a sliding door according to claim 1 wherein: when said rotatable rail is in the second rotation position, said running surface is located generally immediately above said first rotation axis.

6. The guide apparatus for a sliding door according to claim 1 wherein: an opening section corresponding to said sliding door is formed in said main body, said sliding door closing said opening section when in the set position, said plate sliding door opening said opening section when in the non-set position.

7. The guide apparatus for a sliding door according to claim 6, wherein:

a primary guide mechanism is disposed in one of upper and lower edge portions of said opening section and a secondary guide mechanism is disposed in the other of said upper and lower edge portions of said opening section;

said primary guide mechanism includes said rotatable rail disposed in said one of said upper and lower edge portions of said opening section and said runner disposed in one of upper and lower edge portions of said sliding door;

said secondary guide mechanism includes a first guide channel disposed in said other of said upper and lower edge portions of said opening section, said first guide channel extending in a front and rear direction, a second guide channel extending in a right and left direction intersecting said first guide channel and a slider disposed in the other of said upper and lower edge portions of said sliding door; and said slider is guided by said first guide channel to make a movement in a front and rear direction with a vertical displacement when said sliding door is moved between the set position and the preparation position, and said slider is guided by said second guide channel to move in a right and left direction when said sliding door is moved between the preparation position and the non-set position.

* * * * *